US005489456A

United States Patent [19]

Instance

[11] Patent Number: 5,489,456

[45] Date of Patent: Feb. 6, 1996

[54] LABELS AND MANUFACTURE THEREOF

[76] Inventor: David J. Instance, Guinea Hall, Sellindge, Kent TN25 6EG, Great Britain

[21] Appl. No.: 240,773

[22] PCT Filed: Nov. 10, 1992

[86] PCT No.: PCT/GB92/02077

§ 371 Date: May 12, 1994

§ 102(e) Date: May 12, 1994

[87] PCT Pub. No.: WO93/10515

PCT Pub. Date: May 27, 1993

[30] Foreign Application Priority Data

Nov. 12, 1991 [GB] United Kingdom ..... 9123960

[51] Int. Cl.[6] ..... G09F 3/02

[52] U.S. Cl. ..... 428/40; 156/227; 156/250; 156/253; 156/267; 156/268; 281/2; 281/5; 283/81; 428/41; 428/42; 428/43; 428/121; 428/137; 428/138; 428/140; 428/192; 428/195; 428/202

[58] Field of Search ..... 428/40, 41, 42, 428/43, 121, 131, 137, 138, 140, 192, 195, 202; 281/2, 5; 283/81; 156/227, 250, 253, 267, 268

[56] References Cited

FOREIGN PATENT DOCUMENTS

| | | |
|---|---|---|
| 0306125 | 3/1989 | European Pat. Off. . |
| 2207411 | 2/1989 | United Kingdom . |
| 9210828 | 6/1992 | WIPO . |

*Primary Examiner*—Nasser Ahmad
*Attorney, Agent, or Firm*—Rothwell, Figg, Ernst & Kurz

[57] ABSTRACT

A self-adhesive label (54) in the form of a tag for attachment to a neck (56) of a bottle (55), the label (54) being carried on a backing of release material (34), the label (54) comprising a printed sheet (2) which is folded so as to form a body portion (30) and tag portion (32) adjacent thereto, an aperture (48) which extends through the tag portion (32), a weakened tear line (46) which extends through the sheet (2) between the body and tag portions (30,32), and a layer of adhesive (38) disposed on a rearwardly directed surface of the body portion (30) which releasably adheres the label (54) to the backing of release material (34) and by which the body portion (30) may be adhered to a bottle (55). There is also provided a method of producing a succession of such self-adhesive labels (54) carried on a backing of release material (34).

10 Claims, 1 Drawing Sheet

LABELS AND MANUFACTURE THEREOF

BACKGROUND OF THE INVENTION

The present invention relates to a self-adhesive label carried on a backing of release material and to a method of producing a succession of self-adhesive labels carried on a backing of release material.

The present invention particularly relates to self-adhesive labels in the form of a tag having an aperture into which a neck of a bottle may be received.

EP-A-0306125 discloses a tag attachment system for the application of tags to the necks of bottles. The tags suffer from the disadvantage that tag presents only a relatively limited area for carrying printed information and in addition the construction is rather complicated which renders the tag relatively expensive to produce. GB-A-2207411 discloses a label including a tear-off portion which is insertable into a pocket of the label.

SUMMARY OF THE INVENTION

The present invention aims to overcome the disadvantages of known tags.

Accordingly, the present invention provides a self-adhesive label in the form of a tag for attachment to a neck of a bottle, the label being carried on a backing of release material, the label comprising a printed sheet which is folded so as to form a body portion and tag portion adjacent thereto, the printed sheet being folded about at least one longitudinal fold line so as to form a multiple-ply strip and the multiple-ply strip being folded about at least one transverse fold line to form the body and tag portions, an aperture which extends through the tag portion, a weakened tear line which extends through the sheet between the body and tag portions, and a layer of adhesive disposed on a rearwardly directed surface of the body portion which releasably adheres the label to the backing of release material and by which the body portion may be adhered to a bottle.

The present invention also provides a method of producing a succession of self-adhesive labels carried on a backing of release material, the method comprising the steps of: (a) providing a plurality of printed sheets; (b) folding each printed sheet to form a body portion and an adjacent tag portion; (c) providing a web of release material carrying a series of patches of adhesive; (d) applying the folded printed sheets in succession to respective patches of adhesive; and (e) die-cutting through each folded printed sheet to form an aperture through each tag portion whereby the tag portion may be attached to a neck of a bottle and a weakened tear line which extends through the sheet between the body and tag portions.

BRIEF DESCRIPTION OF THE DRAWINGS

Embodiments of the present invention will now be described way of example only with reference to the accompanying drawings, in which.

DESCRIPTION OF THE PREFERRED EMBODIMENTS

Figure 1:
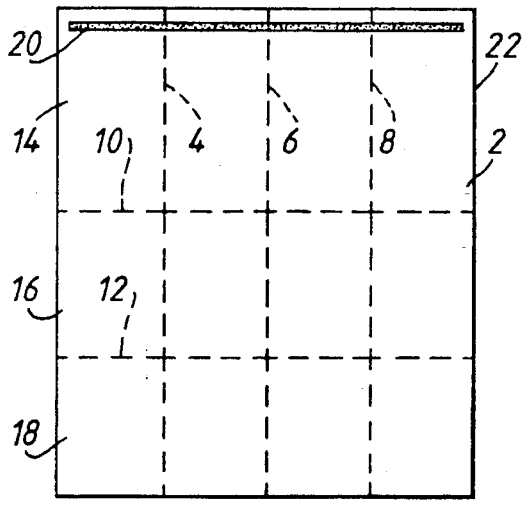
FIG. 1 is a plan view of a printed sheet to form a self-adhesive label in accordance with a first embodiment of the present invention.

Referring to FIG. 1, there is shown a sheet 2 of paper which is printed, for example by lithographic printing, on one or both sides thereof. The sheet 2 is preferably rectangular and is divided into a series of panels by a number of longitudinal and transverse fold lines. In the illustrated embodiment, there are three longitudinal fold lines 4,6,8 and two transverse fold lines 10,12 whereby the sheet 2 is divided into twelve panels. The twelve panels form three transverse rows 14,16,18 of panels, one end row 14 having a greater length in the longitudinal direction than the two remaining rows 16,18 which have substantially the same length in the longitudinal direction. A strip 20 of adhesive, such as a water-soluble PVA adhesive, is applied to one side of the sheet 2 and extends across the transverse row 14 of end panels adjacent the longitudinal edge 22 of the sheet 2.

Figure 2:
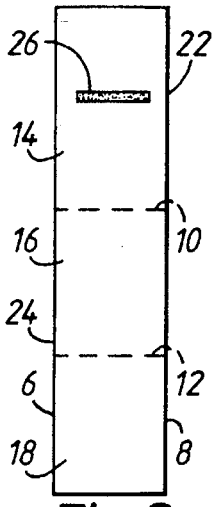
FIG. 2 is a plan view of the printed sheet of FIG. 1 after a first folding operation.

The sheet 2 is then folded in turn about the longitudinal fold lines 4,6,8 to form a folded strip 24 which is shown in FIG. 2. In the folded strip 24, the panels of the transverse row 14 of panels are adhered together by the folded-over adhesive strip 20 so that the entire folded piece 24 is retained in its folded configuration by the adhesive strip 20. In the illustrated embodiment, the sheet 2 has been folded about the original fold lines 4,6,8 so as to have the form of a flattened tube.

Figure 3A:
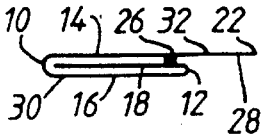
FIGS. 3(*a*) and 3(*b*) are elevational and plan views respectively of the printed sheet of FIG. 2 after a further folding operation.
Figure 3B:
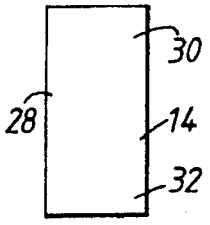

A small area of adhesive 26, such as a water-soluble PVA adhesive, is then applied to an outer surface of the transverse row 14 of end panels at a location spaced from the longitudinal end edge 22 of the folded strip 24. The folded strip 24 is subsequently folded, in turn, about transverse fold lines 12,10 so as to have the configuration shown in FIGS. 3(*a*) and (*b*) in which the resultant folded piece 28 is retained in a folded configuration by the adhesion of transverse row 18 to transverse row 14 by the adhesive area 26. The composition and size of the adhesive area 26 are selected whereby the adhesive area only temporarily adheres the transverse rows 14,18 together so as to retain the folded piece 28 in its folded configuration during manufacture of the labels. The adhesive enables the transverse rows 14,18 to be separated without tearing when it is desired to open the resultant label. As is illustrated in FIG. 3, the adhesive area 26 is preferably located so that it adheres the transverse row 14 to transverse row 18 substantially adjacent the transverse fold line 12. The resultant folded piece 28 consists of a folded body portion 30 comprising the transverse rows 16 and 18 and a major portion of the transverse row 14, and an extending tag portion 32 adjacent thereto consisting of the remaining portion of the transverse row 14. The panels of the extending tag portion 32 are adhered together by the adhesive strip 20 and the body portion 30 is adhered together by the adhesive area 26. The resultant piece 28 is subsequently adhered to a backing of a release material and then die-cut in the manner described hereinafter in order to form the self-adhesive labels of the present invention.

Figure 4:
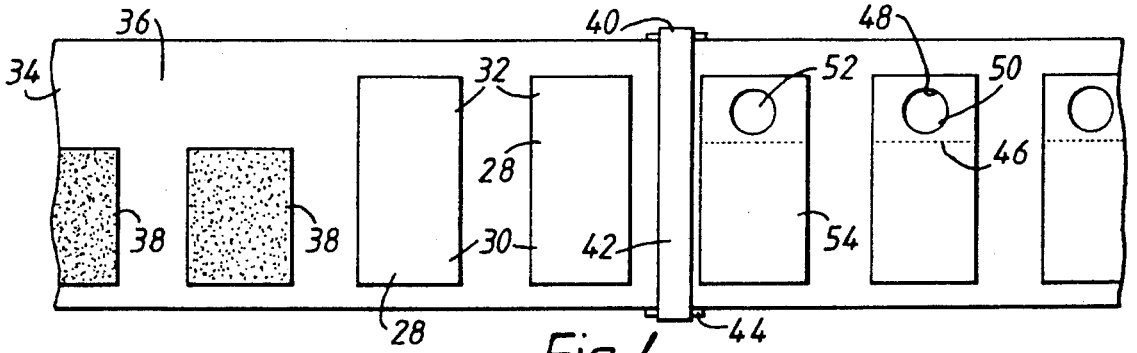
FIG. 4 is a diagrammatic plan view of an apparatus for producing self-adhesive labels in accordance with the method of the present invention.

Referring to FIG. 4, a web of a backing 34 of siliconised release material, being either paper or plastics, is fed out from a reel (not shown) thereof underneath an adhesive coating head (not shown) which applies to the upper surface 36 of the release material 34 a succession of patches 38 of adhesive, which may be a hot melt or water-based dry peel adhesive. Alternatively, the adhesive may be a water-based, hot-melt or solvent-based pressure-sensitive adhesive. Each patch 38 of adhesive has substantially the same dimensions as the exposed surface of the transverse row 16 of panels of the folded piece 28. Subsequently, the folded piece 28 are fed in succession onto the patches 36 of adhesive so that a row of the folded pieces 28 is adhered by the adhesive patches 38 to the release material 34. The folded pieces 28 are fed by a label feed device (not shown) such as that which is described in WO90/14218, EP-A-0098092 or GB-A-2164915. The applied folded pieces 28 are deposited in such a way that the exposed surface of the transverse row 16 covers each adhesive patch 38 whereby the body portion 30 of each applied piece 28 is adhered to the release material 34 and the extending portion 32 of each applied folded piece 28 is not adhered to the release material 34.

The combined web assembly then passes through a die-cutter assembly 40 comprising an upper die-cutting roller 42 and a lower opposed backing roller 44. The die-cutting roller 40 cuts a weakened tear line 46 in the form of a line of perforations through the upper transverse row 14 thereby to divide the body portion 30 from the extending tag portion 32 of the applied folded piece 28 by the perforated tear line. In addition, a circular aperture 48 is cut through the extending tag portion 32 of the applied folded piece 28 at a location spaced between the weakened tear line 46 and the adhesive strip 20. Preferably, a co-extensive aperture 50 is also cut through the release material 34 as this assists the removal of the cut away disc 52 of the extending portion 32 which is blown downwardly through the aperture 50 in the release material 34 together with the cut away disc (not shown) of the release material 34. The resultant assembly of the succession of self-adhesive labels adhered by the patches 38 of adhesive to the release material 34 is then wound into a reel (not shown). The reel may then be mounted in a label applying apparatus in which the self-adhesive labels 54 are subsequently removed from the release material 34 and applied to bottles to be labelled, with the aperture 48 being disposed around a neck of a bottle and the body portion 30 of the label 54 being adhered by the adhesive patch 38 to the body of the bottle.

Figure 5:
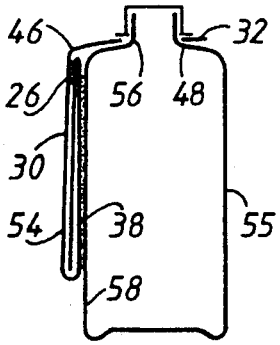
FIG. 5 is a schematic sectional elevation of a bottle carrying a self-adhesive label in accordance with the first embodiment of the present invention.
Figure 6:
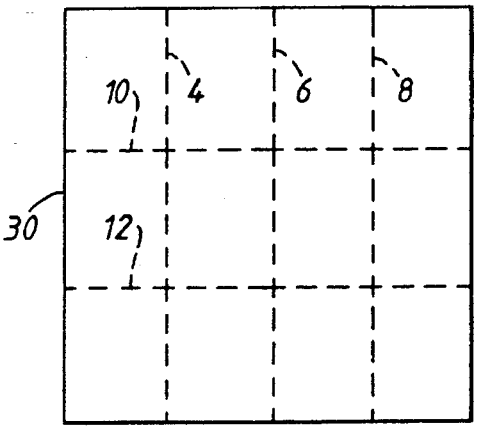
FIG. 6 is a plan view of the removable part of the self-adhesive label shown in FIG. 5.

FIG. 5 shows a bottle 55 with a label 54 in accordance with the invention adhered thereto. The extending tag portion 32 of the label 54 includes the aperture 48 which is disposed around the neck 56 of the bottle 55 and the body portion 30 of the self-adhesive label 54 is adhered by the adhesive patch 38 to the body 58 of the bottle 55. It will be seen that the self-adhesive label 54 is securely held on the bottle 55 both by the disposition of the extending tag portion 32 around the neck 56 and also by the adhesion of the body portion 30 to the body 58 of the bottle 55. When it is desired to access the label 54, a user tears along the weakened tear line 46 so as to separate the body portion 30 from the extending tag portion 32 of the label 54 which latter portion 32 can either be left around the bottle neck 56 or removed entirely from the bottle 55. The body portion 30 is then opened by separating the transverse rows 14,18 at the adhesive area 26. The label 54 may then be unfolded by unfolding about the fold lines 4,6,8,10,12 so as to form a large area sheet which can then be read by the user. When the adhesive patch 38 is composed of a dry peel adhesive, the body portion 30 can be pulled away entirely from the bottle and then the body portion can be unfolded to form a large sheet as shown in FIG. 6. If the adhesive patch 38 is a permanent adhesive or pressure sensitive adhesive, the body portion 30 can remain adhered to the bottle 55 and re-folded after use.

Figure 7:
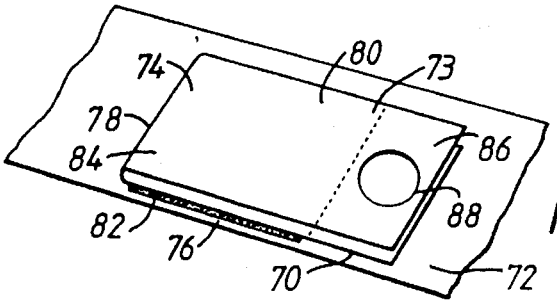
FIG. 7 is a perspective view of a self-adhesive label in accordance with a second embodiment of the present invention.

A second embodiment of a self-adhesive label in accordance with the present invention is illustrated in FIG. 7. FIG. 7 show a self-adhesive label 70 which is carried on a backing 72 of release material. In this embodiment, the label 70 comprises a folded piece 73 having a body portion 74 which is adhered by a patch 76 of adhesive to the release material 72. The applied folded piece 73 has only one transverse fold line 78 whereby the applied folded piece 73 consists of substantially identical upper and lower parts 80,82. The line of perforations 84 extends through both the upper and lower parts 80,82 so as to divide the applied piece 73 into the body portion 74, which is adhered to the release material 72 by the adhesive patch 76, and an extending tag portion 86, which is not so adhered to the release material 72 and is provided with an aperture 88 extending therethrough. In this embodiment, two glue strips 20 are applied to the printed sheet prior to folding with each strip 20 being adjacent a respective longitudinal edge of the printed sheet. The adhesive area 26 is located substantially adjacent to the the end edge of one or both of the rows of panels so that in the resultant label 70 the upper and lower parts of the extending portion 86 of the label 70 are adhered together by the adhesive area 26.

It will be apparent to the man skilled in the art that a number of variations and modifications to the self-adhesive labels of the present invention can be made without departing from the scope of invention. For example, in the illustrated embodiment four longitudinal rows of panels are present but of course any desired number of longitudinal rows can be used provided that the strip can be folded so as to form the folded pieces shown in FIGS. 3 or 7. The folded pieces may be laid across the web 34 as shown in FIG. 4 or along the web as shown in FIG. 7. In an alternative embodiment, the adhesive patch 38 could cover the entire rear surface of the folded piece so that the extending tag portion of the folded piece, which extending portion includes the aperture, can be adhered to the bottle. The aperature may be any desired shape.

I claim:

1. A self-adhesive label in the form of a tag for attachment to a neck of a bottle, the label being carried on a backing of release material, the label comprising a printed sheet which is folded so as to form a body portion and tag portion adjacent and attached thereto, the printed sheet having a longitudinal direction from the tag portion to the body portion and being folded about at least one longitudinal fold line so as to form a multiple-ply strip and the multiple-ply strip being folded about at least one transverse fold line to form the body and tag portions, an aperture which extends through the tag portion, a weakened tear line which extends through the sheet between the body and tag portions so as to divide the body and tag portions, and a layer of adhesive disposed on a rearwardly directed surface of the body portion which releasably adheres the label to the backing of release material and by which the body portion may be adhered to a bottle.

2. A self-adhesive label according to claim 1, further comprising a first adhesive region in the tag portion which adheres together the plies of the sheet forming the tag portion.

3. A self-adhesive label according to claim 2, further comprising a second adhesive region in the body portion which releasably adheres together two adjacent folded parts of the body portion so as temporarily to retain the body portion in a folded configuration.

4. A self-adhesive label according to claim 1 further comprising an aperture in the backing of release material which is coextensive with the aperture in the tag portion.

5. A self-adhesive label according to claim 1 wherein the layer of adhesive disposed on the body portion is a dry peel adhesive.

6. A method of producing a succession of self-adhesive labels carried on a backing of release material, the method comprising the steps of:

(a) providing a plurality of printed sheets;

(b) folding each printed sheet at least once longitudinally and at least once transversely to form a multiply strip having a body portion and an adjacent tag portion attached thereto such that said sheet has a longitudinal direction from said tag portion to said body portion;

(c) providing a web of release material carrying a series of patches of adhesive;

(d) applying the folded printed sheets in succession to respective patches of adhesive; and (e) die-cutting through each folded printed sheet to form an aperture through each tab portion whereby the tag portion may be attached to a neck of a bottle and a weakened tear line which extends through the sheet between the body and tag portions so as to divide the body and tag portions.

7. A method according to claim 6, wherein in die-cutting step (e) the aperture is additionally cut through the adjacent release material and the cut-out parts of the tag portion and the release material are blown away from the web carrying the labels thereon.

8. A method according to claim 2, further comprising the step of adhering together the plies of the sheet forming the tag portion so as to retain the tag portion in a folded configuration.

9. A method according to claim 6, wherein the folding step (b) further comprising adhering together two adjacent folded parts of the body portion so as temporarily to retain the body portion in a folded configuration.

10. A method according to claim 6, wherein the patches of adhesive are composed of dry peel adhesive.

* * * * *

UNITED STATES PATENT AND TRADEMARK OFFICE

CERTIFICATE OF CORRECTION

PATENT NO. : 5,489,456

DATED : February 6, 1996

INVENTOR(S) : David J. INSTANCE

It is certified that error appears in the above-indentified patent and that said Letters Patent is hereby corrected as shown below:

On the Title page, item [30],

Under the "Foreign Application Priority Data" column, the U.K. patent number should be replaced with --9123960.8--.

Column 6, line 13 (clain 8), "2" should be replaced with --6, wherein the folding step (b)--.

Signed and Sealed this

Twenty-fourth Day of September, 1996

*Attest:*

*Attesting Officer*

BRUCE LEHMAN

*Commissioner of Patents and Trademarks*